US005829806A

United States Patent [19]

Sykes

[11] Patent Number: 5,829,806

[45] Date of Patent: Nov. 3, 1998

[54] GOLF BALL RETRIEVER

[76] Inventor: Willard D. Sykes, 1850 Fairway Bend, Bullhead City, Ariz. 86426

[21] Appl. No.: 814,210

[22] Filed: Mar. 11, 1997

[51] Int. Cl.[6] ..... A63B 47/02

[52] U.S. Cl. ..... 294/19.2; 294/99.1

[58] Field of Search ..... 294/19.1, 19.2, 294/22, 99.1; 473/286, 386; 56/332, 333

[56] References Cited

U.S. PATENT DOCUMENTS

| | | | |
|---|---|---|---|
| 761,136 | 5/1904 | Beck | 294/22 |
| 2,523,942 | 9/1950 | Ciambriello | 294/99.1 |
| 2,562,071 | 7/1951 | Stueland | 294/99.1 |
| 2,681,822 | 6/1954 | Daniels | 294/99.1 |
| 3,401,970 | 9/1968 | Russell | 294/99.1 |
| 3,421,788 | 1/1969 | Smith | 294/19.2 |
| 3,770,308 | 11/1973 | Faber et al. | 294/19.2 |
| 3,997,169 | 12/1976 | Bergstrom | 294/19.2 |
| 4,013,295 | 3/1977 | Baughman | 294/19.2 |
| 4,046,413 | 9/1977 | Jeninga | 294/19.2 |
| 4,616,826 | 10/1986 | Trefts | 294/19.2 |
| 5,407,194 | 4/1995 | Snow | 294/19.2 |

FOREIGN PATENT DOCUMENTS

| | | | |
|---|---|---|---|
| 23793 | 2/1902 | United Kingdom | 294/19.2 |

*Primary Examiner*—Dean Kramer

*Attorney, Agent, or Firm*—Angenehm Law Firm, Ltd.; N. Paul Friederichs

[57] ABSTRACT

A golf ball retrieving device including a elongated handle and a ball picking member having a pair of side elements in an acute angular relationship, the panels being in pivotal engagement selectively widening the acute angular relationship to receive a ball between the panels, at least one panel providing a seat for selectively securing a ball between the panels.

16 Claims, 4 Drawing Sheets

Fig.-1
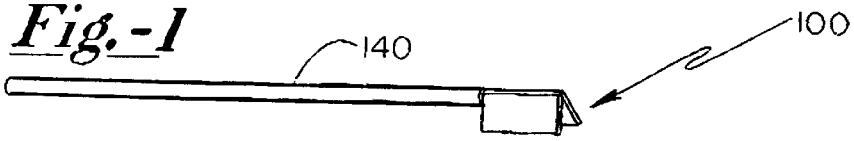
Fig.-2
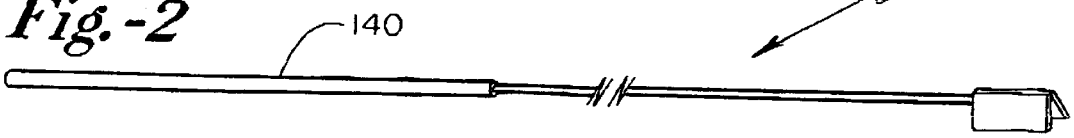
Fig.-3
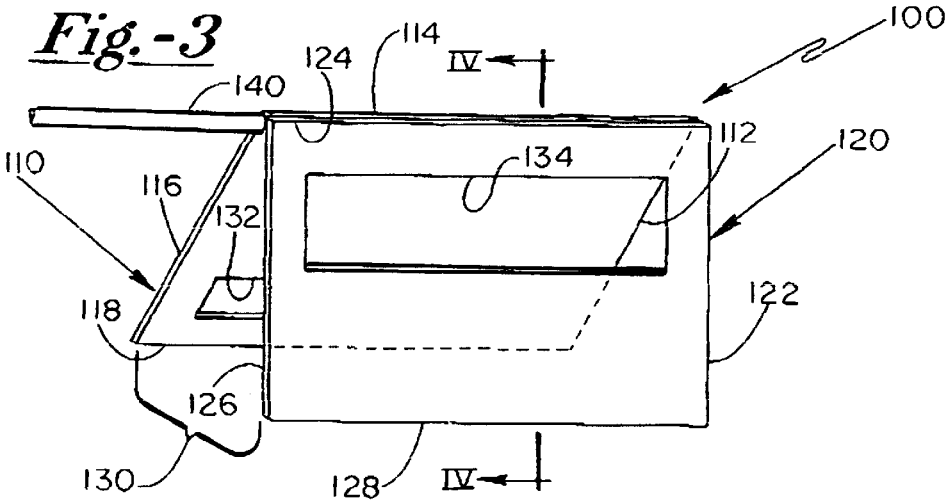
Fig.-4
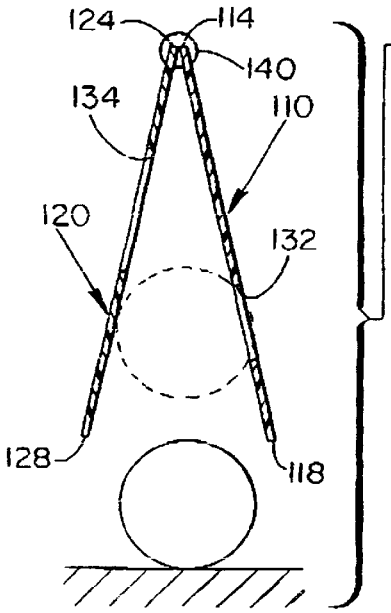
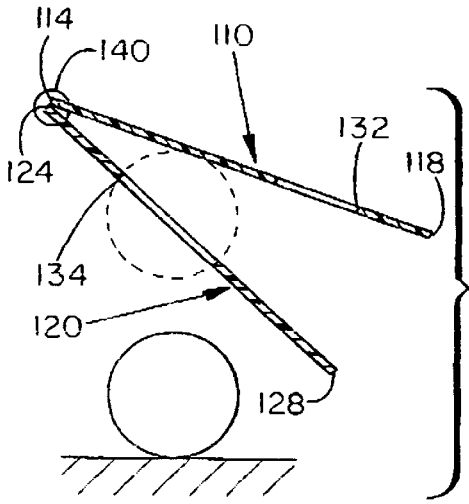
Fig.-5

Fig.-6
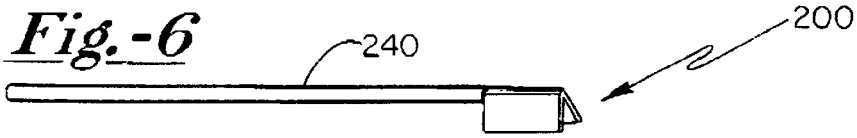
Fig.-7
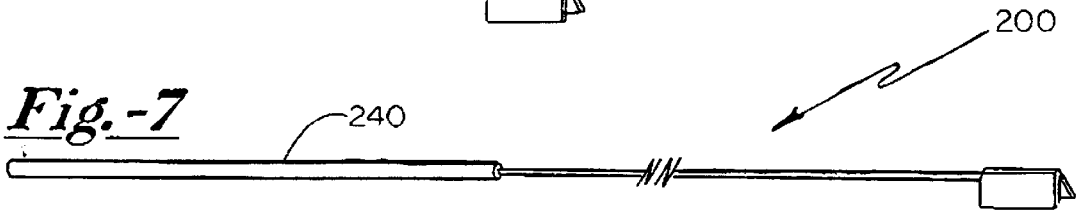
Fig.-8
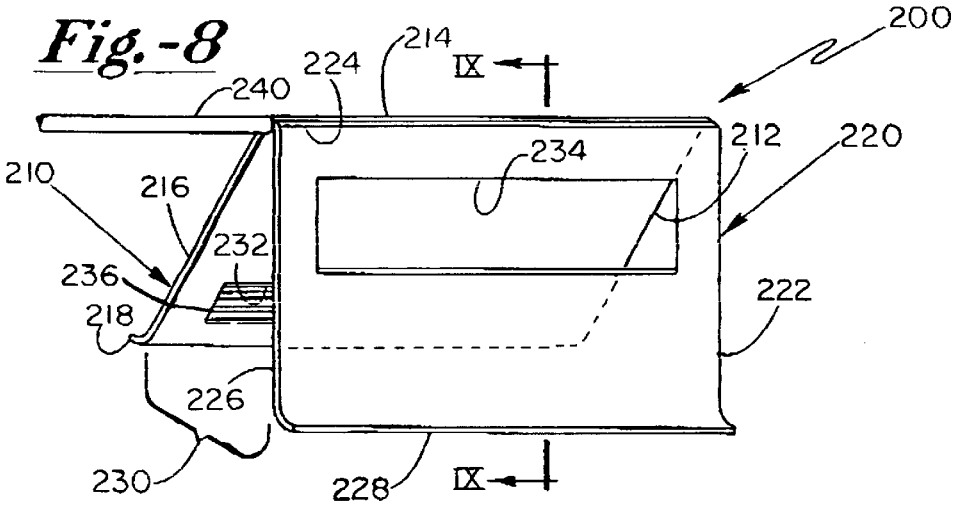
Fig.-9
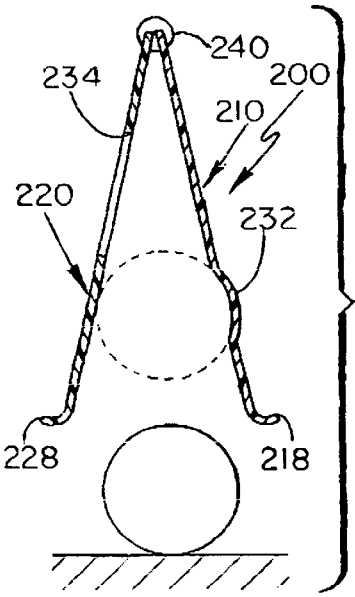
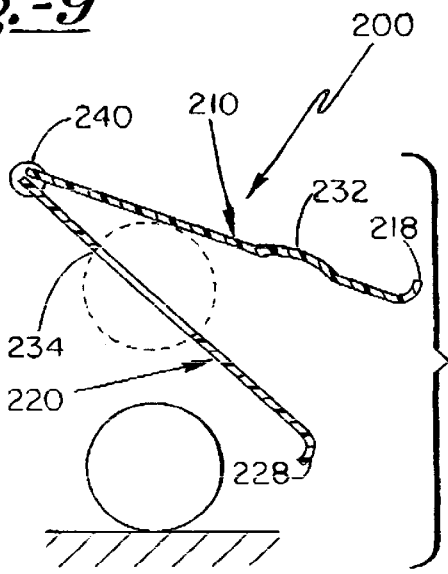
Fig.-10

Fig.-11
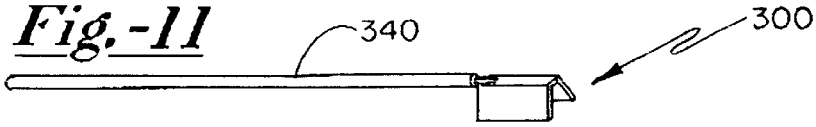
Fig.-12
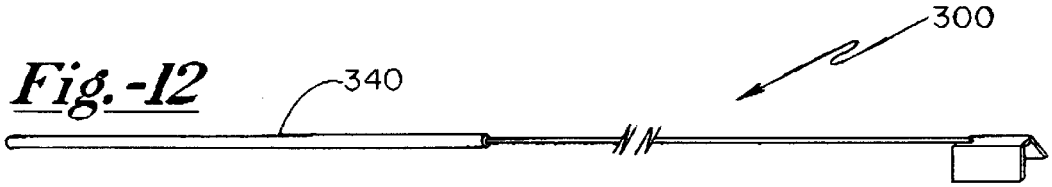
Fig.-13
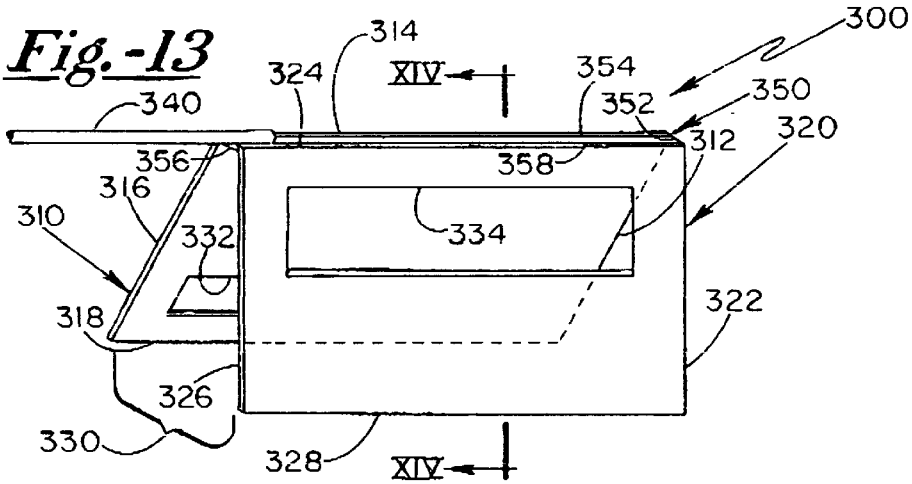
Fig.-14
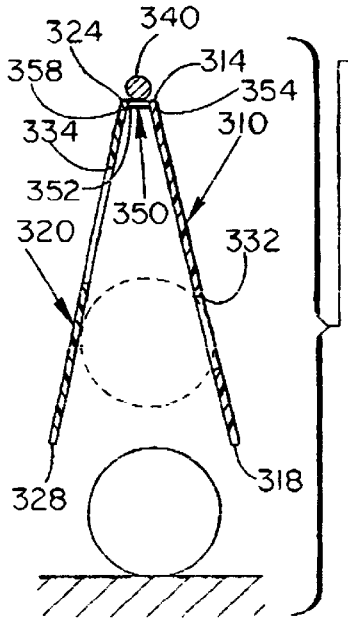
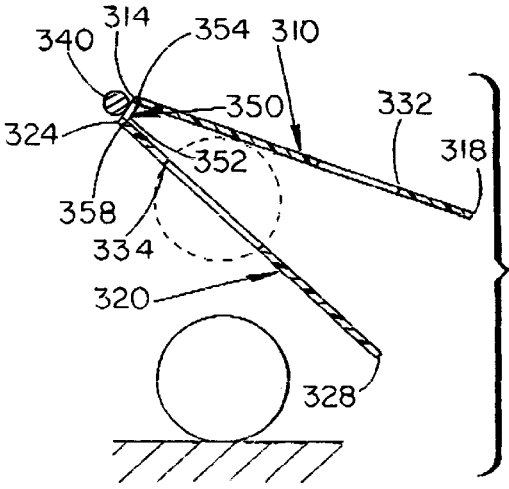
Fig.-15

Fig.-16
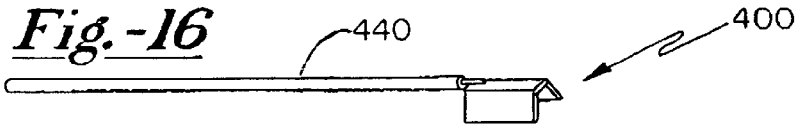
Fig.-17
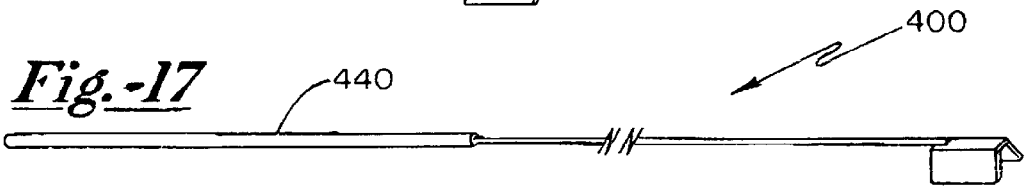
Fig.-18
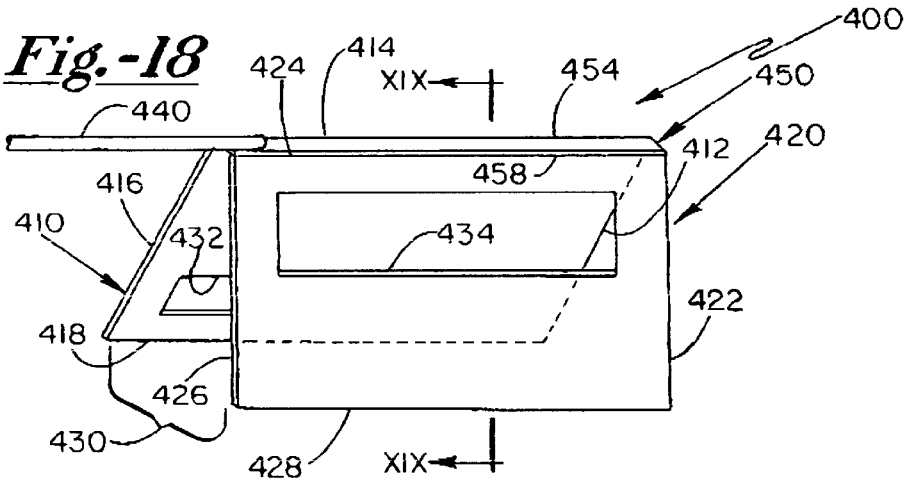
Fig.-19
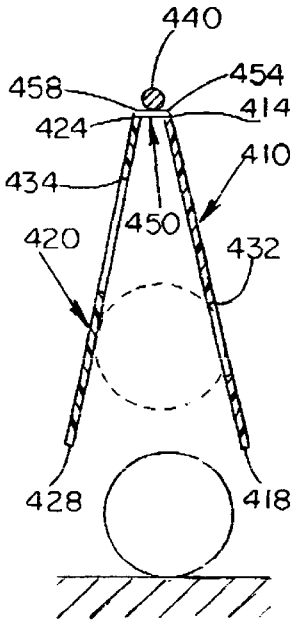
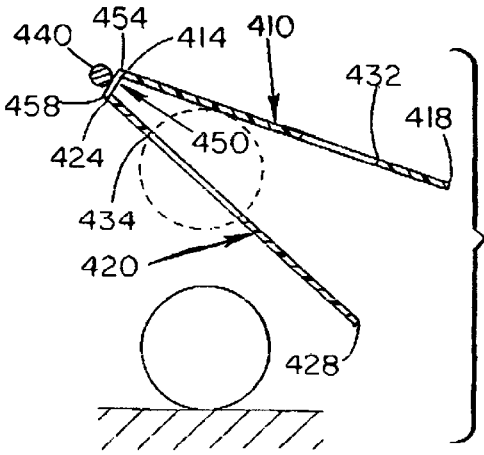
Fig.-20

GOLF BALL RETRIEVER

SPECIFICATION

The present invention relates generally to devices used to capture and retrieve objects that are roughly spherical in form and, more specifically, to a device used to grasp and retrieve golf balls.

BACKGROUND OF THE INVENTION

The sport of golf has been with us for numerous years, beginning in an organized fashion on the old course of St. Andrew's in Scotland. On an extremely basic level, the sport consists of hitting a little ball with a club until the ball falls in a hole, and then repeating this process for a multitude of holes, usually nine or eighteen. Simplistic as it is in concept, the sport can become quite complex as the golfer tries to traverse varying and shifting terrains of the golf course using a variety of clubs of varying pitch and form, all while trying to minimize the number of times the ball must be struck before it falls in the hole. Oftentimes, the golfer cannot even see the target hole as the objective begins.

To make matters even more complex for the golfer, golf course designers will vary the coarseness of the terrain and its topography. In addition, golf course designers will add various hazards such as water and sand or trees and other plant growth to hinder the ball's path to the hole. While a golfer is expected to "play out" of hazards consisting of sand or plant growth, it is usually considered futile to attempt to play out of a water hazard. The typical solution is to commence play with a new ball dropped within one club length of where the ball entered the water. It is a rare golfer who has not entered a water hazard during play at some point in their life.

While there are rules on how to commence play again after sinking below the watery depths, the golfer is left with a dilemma of what to do about the sunken ball. As the sport of golf was created in the frugal nation of Scotland, golfers as a whole are inclined to be somewhat frugal as well. Most golfers will prefer to retrieve their lost ball rather than purchase a replacement. However, most golfers will not wish to go to the extreme of wading into the depths to retrieve the lowly golf ball as these hazards tend to be murky, muddy and slippery ponds, streams and swamps. Some courses (notably in the Southeastern United States) have been known to post warnings of alligators and poisonous snakes in their water hazards.

In response to this desire to remain dry (and alive) while retrieving the golf ball from the nebulous depths of the water hazard, golf ball retrievers have been developed. Typically, these retrievers consist of a cup-like device on the end of a long rod. The cup-like device may be vented to allow water to drain from the device as it is lifted out of the water, or it may be some form of wire cage. In either instance, however, the golfer must get the cup-like device underneath the golf ball in order to scoop it out of the water. This may be no simple task depending upon the underwater terrain. The task is made even more complex by the difficulties of maneuvering the device when its reach extends many feet past the shore line. A more manageable approach may be to simply drop a device over the golf ball to allow capture and retrieval. The present invention seeks to make the sport of golf more enjoyable by easing the retrieval of the precious golf ball from King Neptune's grasp.

SUMMARY OF THE INVENTION

The ball retriever of the present invention may include a telescoping tubular member, e.g. shaft, and a retriever member. The shaft may have a plurality of telescoping shaft portions. The telescoping shaft may be of any suitable lightweight material such as a thin walled steel construction or a suitable polymeric material. The various shaft members have diameters suitable for the telescopic engagement between the respective shaft members In other words the telescoping shaft portions may be telescopingly collapsed for storage in the golf bag. One shaft member may have a grip of any suitable material such as a wrapped strip of polymer or even leather. This grip facilitates easy handling of the device when in use.

The retriever member is not merely a cup but rather is a complex structure including generally a downwardly facing V-shaped channel mechanism having a first element which desirably is in locked engagement with the shaft. In other words this element does not move with respect to the shaft. The retriever member further includes an element that is rotatable preferably about the central axis of the shaft in an arcuate path. The retriever elements may be generally rectangular in shape. These elements may be constructed of a light weight sheet material such as steel or a suitable polymer. One of the elements may be a plate with a slot defined therein. The slot is spaced upwardly from the lower edge of element to grip the ball during retrieval. The slot may be rectangular in shape, being smaller in one dimension and greater in the other dimension than the diameter of a golf ball thereby not permitting the ball to fall through this slot. The other retriever element may have defined therein a slot that is rectangular in shape, being greater in both dimensions than the diameter of a golf ball. This slot may be spaced upwardly from the lower edge of this element a distance sufficient to permit the element to hold the ball against the first mentioned element while retrieving the ball and yet permitting the passing of a golf ball through the slot when desired.

The retriever elements are both supported by the shaft. The second element may be supported with respect to the first element by a pin and hinge-like mechansim. The pin and hinge-like mechanism may rotate thereby permitting the second mentioned retriever element to pivot with respect to first element. A spring may be provided to urge the lower end of the second element toward the first element. The spring may be either a leaf spring or a coil e.g. wrapped spring extending around the pin to urge the lower edge of the second element toward the first element.

A blocking member may be provided to limit the movement of the lower edge of the second element toward the first element. The spacing between the lower edge of the second element and the lower edge of the first element, when in the closed position, may be slightly smaller than the diameter of a golf ball. The spring urges the second element toward the first element and yet is of sufficiently limited force to permit the second retriever element to pivot outwardly when the device is moved downwardly onto a golf ball.

The golf ball retrieving device is normally maintained in a collapsed condition with the telescoping shaft sections contained generally respectively within each other. The overall dimension e.g. length of the retriever may be suitable for storage in a golf bag. Typically the device when in its collapsed condition will be approximately 30 to 36 inches in length.

When the golfer strikes a golf ball and the ball lands in a water hazard, the golfer approaches the location of the golf ball. The golfer then takes the retriever device from the golf bag, extends the telescoping tubular shaft to a length sufficient to reach the golf ball with the retriever. In some instances the golf ball will be located close to solid ground, while in other instances the golf ball may be located further from such turf. Once the length has been properly adjusted, the device is grasped by one or both hands of the golfer with the retriever elements directed generally downwardly.

The golf ball is approached by the retriever, a slight force (e.g. gravity) acts in a downward direction which causes the retriever elements to move apart, a sufficient distance for the golf ball to slide between first and second retriever elements. Once these elements have moved down and around the ball, the spring urges the lower edges of the elements toward each other and the golf ball then becomes lodged or trapped between elements. The open side of the first retriever element is sufficiently limited so that the ball cannot drop out. On the other hand the opening in the second retriever element is sufficiently large that when the device is rotated the ball will drop out of such opening. The opening in the second element may be located upwardly from the lower edge to prevent the ball from dropping out until the device has been rotated to a significant degree. This permits the golfer to retrieve the ball move the retriever to a location over solid ground, rotate the device and drop the ball on solid ground.

An objective of the present invention is to produce a device capable of grasping and retrieving objects that are roughly spherical in form.

An important objective of the present invention is to produce a device capable of grasping and retrieving a golf ball.

A further objective of the present invention is to produce a device capable of grasping and retrieving objects at a distance from the device operator.

Another objective of the present invention is to allow the device to easily release the grasped object when desire.

A fundamental objective of the present invention is to produce a device capable of grasping and retrieving a spherical object by merely dropping the device over the object or by scooping and device from beneath the object.

An objective of the present invention is to produce a device capable of grasping and retrieving objects at variable distances from the device operator.

A feature of the present invention is the creation of a cage formed by two flexible side panels. To create the cage, at least one of the side panels should include a seat for the target object such as an aperture or a depression contained in the side panel. The location of the seat should be such that the lower edge of the seat is below the centerline of the target object when the cage rests on the surface below the object. The side panels may be joined at the top and may expand out at the bottom such that the spacing between the two side panels at the bottom is less than the diameter of the roughly spherical object to be captured. One side panel may have an aperture smaller than the target object while the other side panel may have an aperture larger than the target object. At least two faces of the cage formed by the panels and the bottom opening should contain apertures smaller than the target object in order to conveniently contain the target object after capture. In substitution of the apertures of the side panels, one or both side panels may contain depressions such that the target object can rest in one or both depressions after capture. Only one seat, i.e. aperture or depression, is required to provide a capture mechanism for the target object.

The side panels may be constructed of a material with inherent elasticity, such as most plastics, spring metals and composites, or the flexibility between the side panels may be provided by some method for biasing such as a hinge in combination with a spring or other elastic connection. Providing at least one side panel with an aperture larger than the target object allows for easy removal of the target object from the device.

In operation the device is placed over the target object with the side panels extending downward. By applying pressure from above, the flexible side panels can be made to spread apart to encase the target object. To aid the flexing of the side panels past the object, the bottom ends of the panels may be flared or rounded. As the device is moved downward past the center of the target object, the aperture(s) and/or depression(s) allow the side panels to flex back toward their original positions thus capturing the object. The target object may thus be retrieved. If at least one side panel contains an aperture larger than the target object, the target object may be released from the device by simply rotating the device until the object falls out. If no panel contains an aperture larger than the target object, the object may be removed by spreading the side panels apart until the object is released.

In addition to this fundamental operation of the device of the present invention, the device may be attached to an extension rod to provided the operator with an extended reach. Furthermore, the extension rod may be of a collapsible or extendable fashion to allow an extended reach when in use while providing for more convenient storage when not in use.

BRIEF DESCRIPTION OF THE DRAWINGS

FIG. 1 is a perspective view of the ball retriever of the present invention in the collapsed, e.g. storage position;

FIG. 2 is a perspective view of the ball retriever of the present invention in the extended position;

FIG. 3 is an enlarged perspective view of the golf ball engaging, e.g., ball picking portion of the device of FIG. 1;

FIG. 4 is a cross-sectional view taken along the line IV—IV in FIG. 3 of the engagement of the device with the golf ball;

FIG. 5 is a view similar to FIG. 4 showing a cross-sectional view of the removal of the golf ball from the device;

FIG. 6 is a perspective view of an alternate embodiment of the ball retriever of the present invention in the collapsed, e.g. storage position;

FIG. 7 is a perspective view of the ball retriever of FIG. 6 of the present invention in the extended position;

FIG. 8 is an enlarged perspective view of the golf ball engaging, e.g., ball picking portion of the device of FIG. 6;

FIG. 9 is a cross-sectional view taken along the line IX—IX in FIG. 8 showing a cross-sectional view of the engagement of the device with the golf ball;

FIG. 10 is a view similar to FIG. 4 showing a cross-sectional view of the removal of the golf ball from the device;

FIG. 11 is an enlarged perspective view of another embodiment of the ball retriever of the present invention in the collapsed, e.g. storage position;

FIG. 12 is a perspective view of the ball retriever of FIG. 11 showing the present invention in the extended position;

FIG. 13 is an enlarged perspective view of the golf ball engaging, e.g., ball picking portion of the device of FIG. 11;

FIG. 14 is a cross-sectional view taken along the line XIV—XIV in FIG. 13 showing the engagement of the device with the golf ball;

FIG. 15 is a view similar to FIG. 14 showing removal of the golf ball from the device;

FIG. 16 is a perspective view of a further embodiment of the ball retriever of the present invention in the collapsed, e.g. storage position;

FIG. 17 is a perspective view of the ball retriever of the present invention in the extended position;

FIG. 18 is an enlarged perspective view of the golf ball engaging, e.g., ball picking portion of the device of FIG. 16;

FIG. 19 is a cross-sectional view taken along the line XIX—XIX in FIG. 18 showing the engagement of the device with the golf ball; and FIG. 20 is a view similar to FIG. 19 showing removal of the golf ball from the device.

DETAILED DESCRIPTION OF THE PREFERRED EMBODIMENT

In one form of the preferred embodiment of the present invention as depicted in FIGS. 1–5, the device 100 has as its major components a first side panel 110 and a second side panel 120. Side panels 110 and 120 may be essentially rectangular in nature, as shown in FIGS. 1–5, or they may approximate virtually any other shape. A partial listing of suitable shapes may include geometric shapes such as trapezoidal, triangular, octagonal, circular, oval and others, as well as functionally decorative shapes such as silhouettes of a hand, a sea shell, a fish and more. Many other substantially similar shapes for the side panels will be readily apparent to those skilled in the art.

First side panel 110 may have edges 112, 114, 116 and 118. Second side panel 120 may have edges 122, 124, 126 and 128. Side panels 110 and 120 may be joined along a portion of edges 114 and 124. Alternatively, side panels 110 and 120 may be integral along edges 114 and 124 such that first side panel 110 and second side panel 120 are formed from one piece of material. Edges 118 and 128 of side panels 110 and 120 respectively may be separated by a space 130 such that an acute angle is defined by the nominal planes of first side panel 110 and second side panel 120. Preferably, the spacing 130 at the bottom of side panels 110 and 120 should be less than the outer diameter of the target object to aid capture of the object, yet sufficiently close to the outer diameter such that minimal force is necessary to place the target object between side panels 110 and 120.

In this one form of the preferred embodiment, side panels 110 and 120 may be constructed of a material having inherent elasticity. Such materials may include most plastics including, but not limited to, polyethylene, polypropylene, polyesters and any other plastics and their blends having moderate elasticity such that the side panels may be flexed about the target object without cracking yet still retain the ability to substantially return to their original positions upon release of the stress. In addition, such materials may include spring metals having moderate elasticity. Furthermore, such materials may include composites including, but not limited to, reinforced glass fibers and graphites having moderate elasticity. Finally, any other now known or later developed material or composite having moderate elasticity is suitable for use in this form of the preferred embodiment. Use of a material having inherent elasticity may eliminate the need for a hinge mechanism at the top of the panels.

First side panel 110 may include an aperture 132. The dimensions and shape of aperture 132 are virtually immaterial. The only requirement for the dimensions and shape of aperture 132 is that the combination of dimensions and shape allow at least some part of the target object to extend past the nominal plane of first side panel 110. In the simplest example, using a spherical target object, aperture 132 may be rectangular or alternatively circular in shape with at least one dimension being greater than 0 yet less than the outer diameter of the target object, preferably about 60–80% of the diameter of the target object. Preferably, the lower edge of the aperture 132 will extend below the centerline of the target object when the device 100 rests on the surface beneath the object in order to aid capture of the object in aperture 132.

Second side panel 120 may include an aperture 134. The dimensions and shape of aperture 134 are virtually immaterial. The only requirement for the dimensions and shape of aperture 134 is that the combination of dimensions and shape allow at least some part of the target object to extend past the nominal plane of second side panel 120. In this one form of the preferred embodiment, it may be desirable to allow the release of the target object through aperture 134 by rotating the device 100 such that aperture 134 faces downward and gravity displaces the target object. In this scenario, aperture 134 should have dimensions sufficiently larger than the target object to allow easy passage of the target object through aperture 134. If removal of the target object through aperture 134 is not desired, aperture 134 may then be sized as with aperture 132 such that its dimensions are less than the target object and preferably about 60–80% of the diameter of the target object. If the device 100 contains an aperture 134 whose dimensions are larger than the target object, the lower edge of aperture 134 may extend above the centerline of the object to aid capture of the object in aperture 132. If the device 100 contains an aperture 134 whose dimensions are smaller than the target object, it is preferred that the lower edge of aperture 134 extend below the centerline of the object to aid capture of the object in aperture 134.

To extend the reach of the operator, device 100 may be mounted on an extension rod 140. Extension rod 140 may be mounted to any portion of device 100, but it is preferably mounted along edges 114 and 124. Extension rod 140 may be of a collapsible or extendable fashion to allow an extended reach when in use while providing for more convenient storage when not in use.

In a second form of the preferred embodiment of the present invention as depicted in FIGS. 6–10, the device 200 has as its major components a first side panel 210 and a second side panel 220. Side panels 210 and 220 may be essentially rectangular in nature, as shown in FIGS. 6–10, or they may approximate virtually any other shape. A partial listing of suitable shapes may include geometric shapes such as trapezoidal, triangular, octagonal, circular, oval and others, as well as functionally decorative shapes such as silhouettes of a hand, a sea shell, a fish and more. Many other substantially similar shapes for the side panels will be readily apparent to those skilled in the art.

First side panel 210 may have edges 212, 214, 216 and 218. Second side panel 220 may have edges 222, 224, 226 and 228. Side panels 210 and 220 may be joined along a portion of edges 214 and 224. Alternatively, side panels 210 and 220 may be integral along edges 214 and 224 such that first side panel 210 and second side panel 220 are formed from one piece of material. Edges 218 and 228 of side panels 210 and 220 respectively may be separated by a space 230 such that an acute angle is defined by the nominal planes of first side panel 210 and second side panel 220. Preferably, the spacing 230 at the bottom of side panels 210 and 220 should be less than the outer diameter of the target object to aid capture of the object, yet sufficiently close to the outer diameter such that minimal force is necessary to place the target object between side panels 210 and 220.

To assist passing the target object between edges 218 and 228, edges 218 and 228 may be flared to provide a rounded leading edge, which may act as a guide. Preferably, edges 218 and 228 will be flared away from the center of the device as shown best in FIG. 8. However, edges 218 and 228 may also be flared toward the center of the device as long as a rounded leading edge is presented to the target object.

As with the first form of the preferred embodiment, side panels 210 and 220 may be constructed of a material having inherent elasticity. Such materials may include most plastics including, but not limited to, polyethylene, polypropylene, polyesters and any other plastics and their blends having moderate elasticity such that the side panels may be flexed about the target object without cracking yet still retain the ability to substantially return to their original positions upon release of the stress. In addition, such materials may include spring metals having moderate elasticity. Furthermore, such materials may include composites including, but not limited to, reinforced glass fibers and graphites having moderate elasticity. Finally, any other now known or later developed material or composite having moderate elasticity is suitable for use in this form of the preferred embodiment. Use of a material having inherent elasticity may eliminate the need for a hinge mechanism at the top of the panels.

In place of an aperture as shown in the first embodiment, first side panel 210 of the present embodiment may include a depression 232 extending beyond the nominal plane of first side panel 210. The dimensions and shape of depression 232 are virtually immaterial. The only requirement for the dimensions and shape of depression 232 is that the combination of dimensions and shape allow at least some part of the target object to extend past the nominal plane of first side panel 210. In the simplest example, using a spherical target object, depression 232 may be hemispherical in shape with a diameter in the nominal plane of first side panel 210 greater than 0 yet less than the outer diameter of the target object, preferably about 60–80% of the diameter of the target object. Preferably, the lower edge of the depression 232 will extend below he centerline of the target object when the device rests on the surface beneath the object, acting as an object retaining guard, in order to aid capture of the object in depression 232 Depression 232 may include drainage holes 236.

Second side panel 220 may include an aperture 234. The dimensions and shape of aperture 234 are virtually immaterial. The only requirement for the dimensions and shape of aperture 234 is that the combination of dimensions and shape allow at least some part of the target object to extend past the nominal plane of second side panel 220. In this one form of the preferred embodiment, it may be desirable to allow the release of the target object through aperture 234 by rotating the device 200 such that aperture 234 faces downward and gravity displaces the target object. In this scenario, aperture 234 should have dimensions sufficiently larger than the target object to allow easy passage of the target object through aperture 234. If removal of the target object through aperture 234 is not desired, aperture 234 may then be sized such that its diameter is greater than 0 yet less than the outer diameter of the target object, preferably about 60–80% of the diameter of the target object. If the device 200 contains an aperture 234 whose dimensions are larger than the target object, the lower edge of aperture 234 may extend above the centerline of the object to aid capture of the object in aperture 232. If the device 200 contains an aperture 234 whose dimensions are smaller than the target object, it is preferred that the lower edge of aperture 234 extend below the centerline of the object to aid capture of the object in aperture 234.

To extend the reach of the operator, device 200 may be mounted on an extension rod 240. Extension rod 240 may be mounted to any portion of device 200, but it is preferably mounted along edges 214 and 224. Extension rod 240 may be of a collapsible or extendable fashion to allow an extended reach when in use while providing for more convenient storage when not in use.

In another form of the preferred embodiment of the present invention as depicted in FIGS. 11–15, the device 300 has is its major components a first side panel 310, a second side panel 320 and a top panel 350. Side panels 310 and 320 may be essentially rectangular in nature, as shown in FIGS. 11–15, or they may approximate virtually any other shape. A partial listing of suitable shapes may include geometric shapes such as trapezoidal, triangular, octagonal, circular, oval and others, as well as functionally decorative shapes such as silhouettes of a hand, a sea shell, a fish and more. Many other substantially similar shapes for the side panels will be readily apparent to those skilled in the art. Top panel 350 may be any shape capable of joining with side panels 310 and 320 and, as shown in FIGS. 11–15, may be essentially rectangular in nature.

First side panel 310 may have edges 312, 314, 316 and 318. Second side panel 320 may have edges 322, 324, 326 and 328. Top panel 350 may have edges 352, 354, 356 and 358. First side panel 310 and top panel 350 may be joined along a portion of edges 314 and 354. Second side panel 320 and top panel 350 may be joined along a portion of edges 324 and 358. Alternatively, first side panel 310 and top panel 350 may be integral along edges 314 and 354 and second side panel 320 and top panel 350 may be integral along edges 324 and 358 such that first side panel 310, second side panel 320 and top panel 350 are formed from one piece of material. Edges 318 and 328 of side panels 310 and 320 respectively may be separated by a space 330 such that an acute angle is defined by the nominal planes of first side panel 310 and second side panel 320. Consistent with this preference, side panels 310 and 320 may extend toward the center of device 300 as long as there is at least some space between the bottoms of side panels 310 and 320. Preferably, the spacing 330 at the bottom of side panels 310 and 320 should be less than the outer diameter of the target object to aid capture of the object, yet sufficiently close to the outer diameter such that minimal force is necessary to place the target object between side panels 310 and 320.

In this one form of the preferred embodiment, side panels 310 and 320 and top panel 350 may be constructed of a material having inherent elasticity. Such materials may include most plastics including, but not limited to, polyethylene, polypropylene, polyesters and any other plastics and their blends having moderate elasticity such that the side panels may be flexed about the target object without cracking yet still retain the ability to substantially return to their original positions upon release of the stress. In addition, such materials may include spring metals having moderate elasticity. Furthermore, such materials may include composites including, but not limited to, reinforce glass fibers an graphites having moderate elasticity. Finally, any other now known or later developed material or composite having moderate elasticity is suitable for use in this form of the preferred embodiment. Use of a material having inherent elasticity may eliminate the need for hinge mechanisms between the panels.

First side panel 310 may include an aperture 332. The dimensions and shape of aperture 332 are virtually immaterial. The only requirement for the dimensions and shape of aperture 332 is that the combination of dimensions and shape allow at least some part of the target object to extend past the nominal plane of first side panel 310. In the simplest example, using a spherical target object, aperture 332 may be circular in shape with a diameter greater than 0 yet less than the outer diameter of the target, preferably about 60–80% of the diameter of the target object. Preferably, the lower edge of the aperture 332 will extend below the centerline of the target object when the device 300 rests on the surface beneath the object.

Second side panel 320 may include an aperture 334. The dimensions and shape of aperture 334 are virtually immaterial. The only requirement for the dimensions and shape of aperture 334 is that the combination of dimensions and shape allow at least some part of the target object to extend past the nominal plane of second side panel 320. In this one form of the preferred embodiment, it may be desirable to allow the release of the target object through aperture 334 by rotating the device 300 such that aperture 334 faces downward and gravity displaces the target object. In this scenario, aperture 334 should have dimensions sufficiently larger than the target object to allow easy passage of the target object through aperture 334. If removal of the target object through aperture 334 is not desired, aperture 334 may then be sized as with aperture 332 such that its dimensions are less than the target object and preferably about 60–80% of the diameter of the target object. If the device 300 contains an aperture 334 whose dimensions are larger than the target object, the lower edge of aperture 334 may extend above the centerline of the object to aid capture of the object in aperture 332. If the device 300 contains an aperture 334 whose dimensions are smaller than the target object, it is preferred that the lower edge of aperture 334 extend below the centerline of the object to aid capture of the object in aperture 334.

To extend the reach of the operator, device 300 may be mounted on an extension rod 340. Extension rod 340 may be mounted to any portion of device 300, but it is preferably mounted above top panel 350. Extension rod 340 may be of a collapsible or extendable fashion to allow an extended reach when in use while providing for more convenient storage when not in use.

In still another form of the preferred embodiment of the present invention as depicted in FIGS. 16–20, the device 400 has as its major components a first side panel 410, a second side panel 420, and a biased hinge 450. Side panels 410 and 420 may be essentially rectangular in nature, as shown in FIGS. 16–20, or they may approximate virtually any other shape. A partial listing of suitable shapes may include geometric shapes such as trapezoidal, triangular, octagonal, circular, oval and others, as well as functionally decorative shapes such as silhouettes of a hand, a sea shell, a fish and more. Many other substantially similar shapes for the side panels will be readily apparent to those skilled in the art.

First side panel 410 may have edges 412, 414, 416 and 418. Second side panel 420 may have edges 422, 424, 426 and 428. First side panel 410 may be joined along a portion of edge 414 with biased hinge 450. Second side panel 420 may be joined along a portion of edge 424 with biased hinge 450. Edges 418 and 428 of side panels 410 and 420 respectively may be separated by a space 420 such that an acute angle is defined from edge 418 to edges 414 and 424 to edge 428. Preferably, the spacing 430 at the bottom of side panels 410 and 420 should be less than the outer diameter of the target object to aid capture of the object, yet sufficiently close to the outer diameter such that minimal force is necessary to place the target object between side panels 410 and 420.

To assist passing the target object between edges 418 and 428, edges 418 and 428 may be essentially cylindrical in nature to provide a rounded leading edge. In addition, edges 418 and 428 may be any other shape providing a rounded leading edge. This is best shown in FIG. 18.

In this one form of the preferred embodiment, side panels 410 and 420 may be constructed of a rigid, semi-rigid or moderately elastic material. Such materials may include most plastics including, but not limited to, polyethylene, polypropylene, polyesters, polystyrene, polybutylene, polyvinylchlorides and any other plastics and their blends having the ability to substantially retain their shape. In addition, such materials may include most metals including, but not limited to, steel, copper, aluminum, magnesium and any other metals or their alloys having the ability to substantially retain their shape. Furthermore, such materials may include composites including, but not limited to, reinforced glass fibers and graphites having the ability to substantially retain their shape. Finally, any other now known or later developed material or composite having the ability to substantially retain its shape is suitable for use in this form of the preferred embodiment.

Biased hinge 450 may be a spring-loaded hinge as shown best in FIG. 19. Alternatively, the method of biasing hinge 450 may include a spring or other elastic connection extending between edges 412 and 422 and/or edges 416 and 426. Furthermore, a limiter may be employed to limit the inward travel of side panels 410 and 420 due to the biasing of biased hinge 450. Limiter 452 may be integral with either or both side panels 410 and 420 or it may be separate component.

First side panel 410 may include an aperture 432. The dimensions and shape of aperture 432 are virtually immaterial. The only requirement for the dimensions and shape of aperture 432 is that the combination of dimensions and shape allow at least some part of the target object to extend past the nominal plane of first side panel 410. In the simplest example, using a spherical target object, aperture 432 may be circular in shape with a diameter greater than 0 yet less than the outer diameter of the target object, preferably about 60–80% of the diameter of the target object. Preferably, the lower edge of the aperture 432 will extend below the centerline of the target object when the device 400 rests on the surface beneath he object in order to aid capture of the object in aperture 432. Second side panel 420 may be void of any seat. In other words, second side panel 420 may lack either an aperture or a depression.

To extend the reach of the operator, device 400 may be mounted on an extension rod 440. Extension rod 440 may be mounted to any portion of device 400, but it is preferably mounted along the top of biased hinge 450. Extension rod 440 may be of a collapsible or extendable fashion to allow an extended reach when in use while providing for more convenient storage when not in use.

In operation of any of the aforementioned embodiments, the operator places the device on top of the target object such that the bottom edges extend downward. The operator then applies pressure from above to force the bottom edges of the side panels to extend downward past the center of the target object. As the center of the target object passed the lower edge of an aperture or depression, the object will be forced beyond the nominal plane of at least one side panel, allowing the bottom edges of the side panels to return toward their original positions. The target object is now captured.

Removal of the target object from the device depends upon whether an aperture larger than the target object has been included in the device. If an aperture larger than the target object has been included in one of the side panels, the device may be rotated until this aperture is facing downward, thus allowing gravity to dislodge the target object from the device through the aperture. If an appropriate aperture has not been included, the operator may manually dislodge the target object from the device by spreading the bottom edges of the side panels sufficiently to allow removal of the target object.

Having now described the invention in detail, those skilled in this art will have no difficultly in making changes and modifications in the individual parts or their relative assembly in order to meet specific requirements or conditions. Such changes and modifications may be made without departing from the scope and spirit of the invention, as set forth in the following claims. In particular, it will be readily apparent to those skilled in this art that individual features of the aforementioned examples may be combined and substituted to produce many more equivalent devices.

I claim:

1. A device for capturing a target object comprising:

a first side panel having a top edge and a bottom edge, the first side panel defining an aperture, the aperture being sized to allow a target object to pass therethrough;

a second side panel having a top edge and a bottom edge, the top edges of the first and second side panels being joined via a flexible relationship, the lower edges of the first and second side panels being separated a known distance such that the side panels define an acute angle, the side panels being formed of a member selected from the group consisting of plastics, composites and metals; and a rod portion attached to the side panels.

2. A device for capturing a target object comprising:

a first side panel defining an aperture, the aperture being sized to allow a target object to pass therethrough; and a second side panel being joined to the first side panel, an aperture defined by the second side panel, the aperture being sized sufficiently small enough to prevent a target object from passing therethrough, the lower edges of the first and second side panels being separated a known distance;

means for accepting a target object into the device; and means for selectively securing a target object between the first and second side panels.

3. The device of claim 2 wherein the side panels are formed of a member selected from the group consisting of plastics, composites and metals.

4. The device of claim 3 wherein the plastics comprise at least one member selected from the group consisting of polyethylene, polypropylene, polyesters and any other plastics and their blends having moderate elasticity.

5. The device of claim 3 wherein the metals comprise at least one member selected from the group consisting of spring metals and any other metals having moderate elasticity.

6. The device of claim 3 wherein the composites comprise at least one member selected from the group consisting of reinforced glass fibers, graphites and any other composites and their blends having moderate elasticity.

7. The device of claim 2 wherein the means for securing comprises at least one member selected from the group consisting of apertures and depressions.

8. The device of claim 2 wherein the first and second side panels are joined in a flexible relationship.

9. The device of claim 8 further comprising a spring, the spring joining the first and second side panels in the flexible relationship.

10. The device of claim 8 wherein the first and second panels are integral and the panels are formed of a flexible material.

11. The device of claim 2 wherein the means for accepting comprises:

means for altering the distance between the lower edges of the first and second side panels.

12. The device of claim 2 further comprises a rod portion.

13. The device of claim 2 further comprises a target object, the target object being a golf ball.

14. The device of claim 2 wherein the first panel is in a hinged relationship with the second panel.

15. A method for capturing a target object comprising:

providing first and second side panels arranged in an acute angular relationship, the side panels each having a bottom edge;

passing a target object between the bottom edges of the side panels thereby accepting a target object between the side panels;

selectively securing a target object between the side panels; and rotating the side panels to release the target object through an aperture defined in one of said side panels.

16. The device of claim 15 wherein the target object is a golf ball.

* * * * *